US006422841B2

(12) United States Patent
Kurisu

(10) Patent No.: US 6,422,841 B2
(45) Date of Patent: Jul. 23, 2002

(54) CAT AND MOUSE TYPE ROTARY DEVICE UTILIZING GROOVES AND RODS FOR POWER CONVEYANCE

(76) Inventor: Mikio Kurisu, 1-21-24-203 Kawanishi, Iwakuni-shi, Yamaguchi-prefecture (JP), 741-0082

( * ) Notice: Subject to any disclaimer, the term of this patent is extended or adjusted under 35 U.S.C. 154(b) by 0 days.

(21) Appl. No.: 09/865,533

(22) Filed: May 29, 2001

(30) Foreign Application Priority Data

May 29, 2000 (JP) ..... 2000-201595
Dec. 26, 2000 (JP) ..... 2000-404781

(51) Int. Cl.[7] ..... F01C 1/067; F01C 1/077
(52) U.S. Cl. ..... 418/36; 418/38
(58) Field of Search ..... 418/36, 38

(56) References Cited

U.S. PATENT DOCUMENTS 1,973,397 A * 9/1934 Stromberg ..... 418/36
2,126,795 A * 8/1938 McIntyre ..... 418/36
3,890,939 A * 6/1975 McIntosh ..... 418/38

FOREIGN PATENT DOCUMENTS

DE 1965865 * 5/1971 ..... 418/36

* cited by examiner

*Primary Examiner*—John J. Vrablik
(74) *Attorney, Agent, or Firm*—Young & Thompson

(57) ABSTRACT

A cat and mouse type device includes at least one rod fixed to a shaft with at least one planetary gear rotatably attached to an end of the rod. Bars extending away from the planeatary gear ride in grooves on the faces of two rotors. The planetary gear rotates around a fixed sun gear attached to the housing, so that the two rotors rotate with respect to one another and with respect to the housing in a predetermined manner. Protuberances may be provided to extend away from the rotors and the planetary gear to interact with one another during rotation, preventing the rotors from deadlocking.

21 Claims, 11 Drawing Sheets

CAT AND MOUSE TYPE ROTARY DEVICE UTILIZING GROOVES AND RODS FOR POWER CONVEYANCE

BACKGROUND OF THE INVENTION

1. Field of the Invention

The invention relates to a cat and mouse type rotary engine, as well as a similarly configured cat and mouse type fluid compressor/blower.

2. Description of the Related Art

Cat and mouse type rotary engines have used two irregularly shaped gears outside of the housing. Rotorheads are powered by the ignition of a fuel/air mixture, then two rotors convey the power to the two separate external gears, and those gears mesh respectively with two additional gears. The displacement of the meshing point of either set of two gears is either longer or shorter than that of the other set. This difference in displacement distance between the two sets results in a corresponding difference in the moments of force. Through such a mechanism, the power is converted to a rotational motion, i.e., an output shaft rotates in a direction determined by the larger of the moments of force.

This underlies a problem inherent in the prior art. There is a point in operation of the conventional cat and mouse device where the larger moment of force becomes smaller than the competing moment of force. Despite the values of the competing forces, the rotors continue to move in a direction of the smaller force because of the inertia of the rotors. Therefore, the prior cat and mouse type rotary engine was impractical for widespread use, due to a severe damage and heavy abrasion of gears caused by these features.

There is one cat and mouse type rotary engine design that overcomes such defect, such design being described in U.S. Pat. No. 5,224,847, whose inventorship is the same as that of the present invention. This design uses gears that do not switch between the gear set of a larger moment of force and that of a smaller moment of force during the combustion expansion portion of the cycle. However, the gears used in the engine could not be easily produced.

There are other cat and mouse type rotary engine designs which do not use gears, such as that of Japanese Patent Application Hei 04-212339. This design utilizes a dynamo-electric mechanism to gain rotational motion. However, use of a dynamo makes for a complicated, large, and heavy device, with the attendant reduced efficiency of power conversion.

SUMMARY OF THE INVENTION

The cat and mouse type rotary engine of this invention includes a groove arranged on a side of each rotor. Over the course of a full rotation of the rotor, the distance between a point along the groove and an axis of rotation of the rotor changes. The groove may include arc and line sections whose tangential line is different from that of other parts of the groove relative to rotational direction. The groove moves a small bar that fits into the groove in a manner that the bar can freely slide along the groove. A component of a force toward a rotational movement provided to the bar is larger than that of another bar, which rides in another groove. The larger force is drawn to a gear which may be a planetary gear that is held by a rod so that the rod, firmly attached to an output shaft, rotates the output shaft in the intended direction.

The present invention has as its object a practical cat and mouse type rotary engine, a cat and mouse type rotary engine with fluid compressor/blower, and a cat and mouse type rotary fluid compressor/blower driven an external power source, to run: 1) without damage or heavy abrasion to any parts; 2) with efficient and unstrained conversion of power; 3) by using parts that may be produced without undue difficulty; 4) utilizing a simple and small structure; and 5) without unusual manufacturing requirements, with a resulting low process cost and high productivity.

These objects are achieved through the present design for a cat and mouse type device including: a housing; a shaft rotatably mounted within the housing; first and second rotors rotatably mounted within the housing, each of the rotors having at least two rotorheads arranged around a perimeter of the rotor, the rotors being mounted within the housing to define an annular volume, with the rotorheads dividing the annular volume into a plurality of chambers, each of the rotors having a groove disposed on a face of the rotor; at least one rod secured to the shaft within the housing; at least one primary gear rotatably mounted to each of the at least one rod; at least one secondary gear mounted within the housing and surrounding the shaft; a plurality of bars extending away from the at least one primary gear; at least one inlet passage and at least one outlet passage in the housing, each said inlet and outlet passage opening into the annular volume; wherein each of the bars is arranged to ride in one of the rotor grooves and each of the at least one primary gear is meshed with the secondary gear.

It is another object of the present invention to provide a cat and mouse type device which is configured to prevent improper rotation of the rotors due to unintended movement of the bars. This is achieved by further including in the cat and mouse engine primary gear protuberances extending away from each said primary gear, and rotor protuberances extending away from each said rotor. The primary gear protuberances are arranged to interact with the rotor protuberances to prevent the rotors from deadlocking during operation.

BRIEF DESCRIPTION OF THE DRAWINGS

The invention will be described through reference to the attached drawing figures, in which.

DESCRIPTION OF THE PREFERRED EMBODIMENTS

Figure 1:
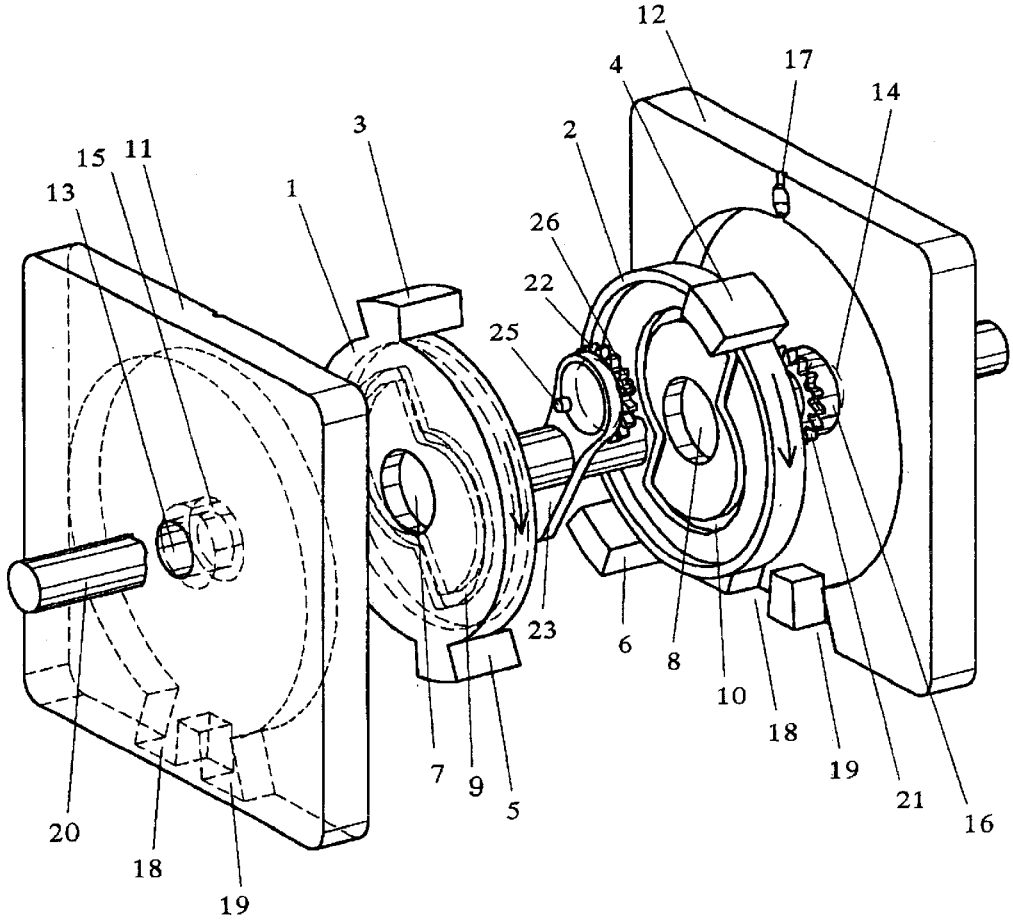
FIG. 1 is an exploded view of an embodiment of the invention utilizing a single rod positioned between two rotors.

FIG. 1 illustrates rotors 1 and 2. Rotorheads 3 and 5 are attached a perimeter of rotor 1, and rotorheads 4 and 6 are attached to the perimeter of rotor 2. In the embodiment illustrated in FIG. 1, the rotorheads of each rotor are diametrically opposed. Holes 7 and 8 are centered on rotors 1 and 2, respectively. Rotors 1 and 2 are located within the housing, which is illustrated as being split into housing halves 11 and 12 along a plane arranged perpendicular to an axis of rotation of shaft 20.

The rotors 1 and 2 and the housing halves 11 and 12 together define an airtight annular volume. As the rotors 1 and 2 rotate with respect to one another and the housing 11 and 12, the rotorheads 3–6 divide the annular volume into four airtight arcuate chambers of changing arc length. The airtight nature of the volume and the arcuate chambers is achieved using appropriate seals as well as proper dimensioning of all the parts.

The housing has an igniter or fuel injection nozzle 17, intake passage 18, and exhaust passage 19. Valves for the intake and exhaust passages are not required, but may be included.

Cylindrical walls 15 and 16 surround the shaft 20 and extend inward from an inner side of housing halves 11 and 12, respectively. An end of cylindrical wall 16 is integrated with a sun gear 21. Cylindrical walls 15 and 16 function as fixed shafts for rotors 1 and 2 to rotate around. Therefore, the external diameter of the cylindrical walls 15 and 16 is slightly smaller than the diameter of the shaft holes 7 and 8 of rotors 1 and 2.

Rod 23 is firmly attached to output shaft 20, and an end of rod 23 holds planetary gear 22. One side of planetary gear 22 cylindrically extends in a direction parallel to the rotational axis of shaft 20, and the cylindrical extension is held by rod 23 so that it may freely rotate with respect to the rod in a plane perpendicular to shaft 20. Planetary gear 22 meshes with sun gear 21. Planetary gear 22 has bars 25 and 26 which are arranged on opposite sides of the planetary gear 22 and generally diametrically opposite one another also. The bars 25 and 26 extend generally parallel to the axis of rotation of the shaft 20. For balance purposes, the rod 23 also extends past the shaft 20 opposite the planetary gear 22.

Grooves 9 and 10 are arranged on the sides of rotors 1 and 2, respectively. The grooves face the bars on planetary gear 22. Each of grooves 9 and 10 forms a complete circuit on the respective rotor face. Each groove may be divided into a plurality of cycles, with adjacent cycles meeting at end points. As illustrated in FIG. 1, each groove is generally shaped as overlapping commas. The point of each groove most distant from the rotational axis of shaft 20 (the tip of each comma) is positioned near a corresponding rotorhead. The grooves 9 and 10 are arranged on the rotors 1 and 2 so that when the rotor rotates in its intended clockwise direction, an imaginary line extending from the rotational axis of shaft 20 will be crossed sequentially by a tip of the comma, a curved portion of the comma, a V-shaped section, and a generally straight section, before again crossing a comma tip.

The distance between each comma tip of each groove 9 and 10 and the rotational axis of shaft 20 should be the same as the most distant point of the path traveled by bar 25 or 26 from the same rotational axis as the planetary gear 22 travels around the sun gear 21. Similarly, the distance between the innermost point of the V-shaped section of grooves 9 and 10 and rotational axis should be the same as the nearest point of the path traveled by the bar 25 or 26 with respect to the rotational axis.

Figure 2:
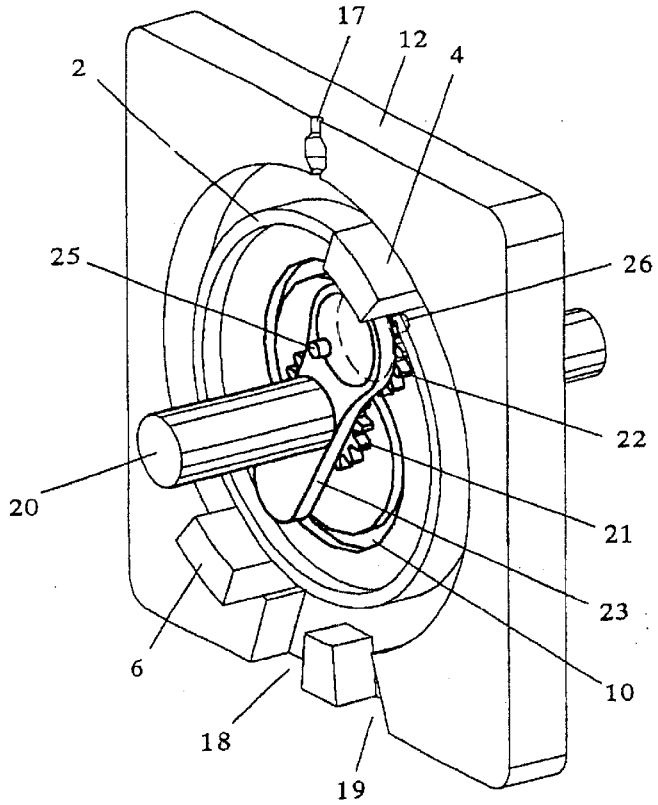
FIG. 2 is a view of a portion of one embodiment of the invention.

FIG. 2 illustrates some of the components of the exploded view of FIG. 1 in their operational positions. Planetary gear 22 is meshed with sun gear 21, and bar 26 is positioned in groove 10.

The bars 25 and 26 have a round cross-section with a diameter slightly smaller than the breadth of both grooves 9 and 10. As illustrated, bar 25 will ride in groove 9 of rotor 1, and bar 26 will ride in groove 10 of rotor 2 in such a manner that bars 25 and 26 can slide freely within the corresponding grooves. When two bars 25 and 26 are positioned in grooves 9 and 10, the two rotors and output shaft can no longer rotate freely with respect to one another.

There should be a sufficient space between sides of rotors 1 and 2 so that the rod 23 and the planetary gear 22 do not touch the sides of the rotors 1 and 2 when the rod 23 and planetary gear 22 rotate around shaft 20. Elements which are meant to slide against other elements, such as edges of grooves 9 and 10, portions of bars 25 and 26 that fit into the grooves 9 and 10, holes of rotors 1 and 2, cylindrical walls 15 and 16, the cylindrical extension of the planetary gear 22, the shaft 20, the holes 13 and 14 in the housing halves, and the hole in the rod 23 to contain the cylindrical extension should be equipped with material that will reduce friction, such as sintered metal, rollers, and/or bearings.

The grooves 9 and 10 engraved on sides of rotors 1 and 2 convey power from expansion of the combustion gases to the bar 23 in a way that the bar receives a different strength of component of the expansion force at one point in the cycle than at another point. Therefore, the shape of the groove is not limited to the dual-comma shape described above. A part of the groove can be a straight line or a slightly curved line, while another part of the groove can be an arc. The tips and V-points of a dual-comma shaped groove can be rounded so that the bar 25 or 26 can slide through the points smoothly. Furthermore, the cross-section of the bar can be a shape other than a circle, such as a semicircle or a rectangle so that it can receive a component of force from the groove within which it rides more efficiently. All of the described shapes, including the groove and the cross-section of the bar can vary so that the shape helps the structure run smoothly and convey power efficiently.

A gear ratio of the sun gear to the planetary gear is 1:1 when each rotor has 2 rotorheads. When 4 rotorheads are attached to each rotor, the gear ratio of the sun gear to the planetary gear is 2:1. When 6 rotorheads are attached to each rotor, the gear ratio of the sun gear to the planetary gear is 3:1, and so on. The shape of the groove on the side of each rotor, accordingly, approximates a pinwheel that has two tips (the dual-comma design discussed above), four tips, six tips, and so on.

Additionally, each rotor can have attached an odd number of rotorheads, such as 3 or 5, and so on. In that case, the gear ratio of the sun gear to the planetary gear is 3:2, 5:2, and so on. Accordingly, the shape of the groove should be a pinwheel that has 3 tips, 5 tips, and so on.

When each rotor has two rotorheads, no more than one of any of the processes of intake, compression, power, and exhaust is taking place at any one time. When 4, 6, or more even numbered rotorheads are installed on each rotor, and plural intake and exhaust passages and igniters/fuel injectors are installed in a housing, then plural processes of intake, compression, power, and exhaust can take place at one time in the device. When 3, 5, or more odd numbered rotorheads are installed on each rotor, while one or two cycles of intake, compression, power, and exhaust is (are) taking place in 4 or 8 chambers, a cooling cycle also takes place using the remaining chambers at the same time. If a tank or a nozzle is attached to the exhaust passages used for cooling, then air/fluid compression or blowing can be accomplished instead of cooling.

In the above embodiment, the planetary gear 22 has a cylindrical extension projection in a direction parallel to the rotational axis of the shaft. The shape of the planetary gear, however, can be like a combination of a regular, flat gear, a disk and an interconnecting shaft. The relatively small diameter shaft connects the larger diameter gear and disk. In such an arrangement, one of the bars 25 and 26 extends away from the flat gear and the other extends away from the disk. In this way, appropriately sized surfaces for the gear and disk are provided, interconnected by a smaller diameter shaft.

Figure 12:
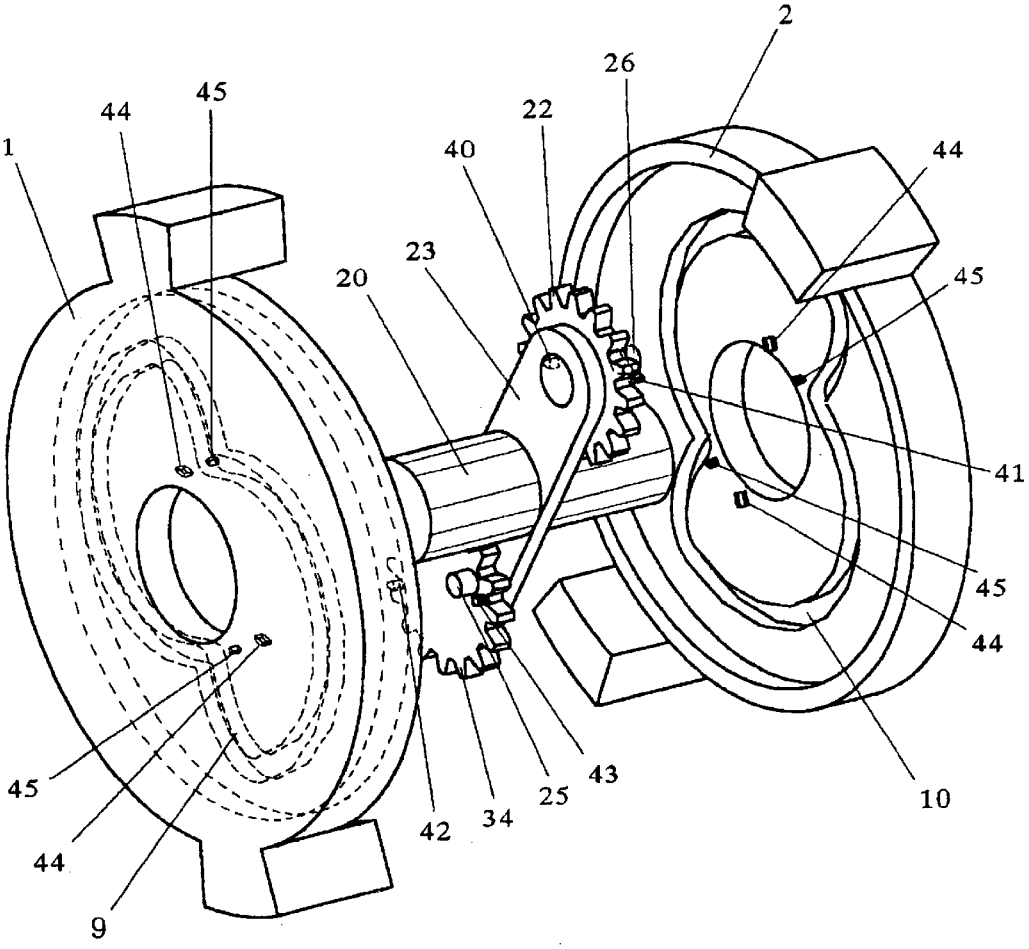
FIG. 12 is an exploded view of another embodiment utilizing the protuberances.

In another embodiment, two separate planetary gears, which do not include cylindrical extensions but do include a shaft, can be installed on opposing ends and opposing faces of rod 23, as illustrated in FIG. 12 one extending away from each of the housing halves. One of the planetary gears 34 meshes with a sun gear on the left housing half, and another planetary gear 22 meshes with a sun gear on the right housing half. Each planetary gear has only one bar extending away therefrom, as each planetary gear interacts with only one rotor. In FIG. 12, bar 26 extends away from planetary gear 22, while bar 25 extends away from planetary gear 34. While FIG. 12 illustrates an embodiment which includes protuberances also extending away from each of the planetary gears, this is not a requirement of a two planetary gear/single rod embodiment.

In another embodiment, the cylindrical wall 15 on the left housing half 11 can be eliminated so that rotor 1 would rotate directly on shaft 20. When only an end of the rod 23 holds the planetary gear, the opposite end of the rod that extends on the other side of shaft 20 is not functionally necessary. But that part is left as is to maintain balance.

Figure 5:
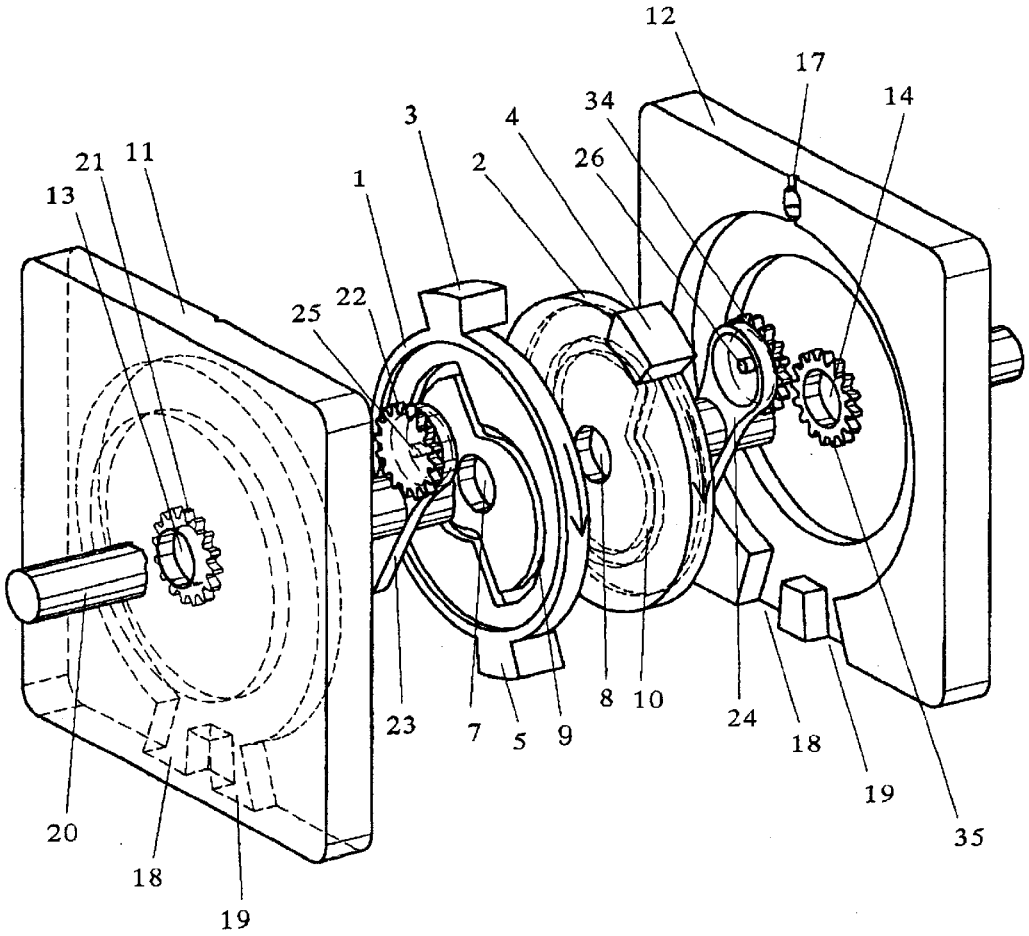
FIG. 5 is an exploded view of an embodiment of the invention utilizing two rods located outside the rotors.

In the embodiments considered thus far, only one rod 23 is used. FIG. 5 illustrates another embodiment that uses two rods 23 and 24 firmly attached to shaft 20. Each of the rods is located between a housing half and a corresponding rotor. As shown in FIG. 5, rod 23 is positioned between rotor 1 and housing half 11, while rod 24 is positioned between rotor 2 and housing half 12. In this embodiment, two separate sun gears 21 and 35 are incorporated with short extending cylindrical walls of the housing. Rotors 1 and 2 rotate directly on shaft 20, instead of rotating on the cylindrical walls extending away from the housing halves as in the previous embodiments. Therefore, the diameter of shaft 20 is slightly smaller than the diameter of the shaft holes 7 and 8 of rotors 1 and 2.

Planetary gears 22 and 34, which have cylindrical extensions, are each positioned at an end of one of the rods 23 and 24, and these planetary gears mesh with the sun gears 21 and 35. Each planetary gear has one of bars 25 and 26 which ride in grooves 9 and 10, so that the bars can slide freely with the corresponding grooves. There should be a space between the sides of rotors 1 and 2 and the inner sides of the housing halves so that the rods 23 and 24 and planetary gears 22 and 34 do not touch the rotors and the housing when the rods 23 and 24 and planetary gears 22 and 34 rotate.

This two-rod embodiment can be modified so that each housing half has an internal gear installed within a hollow on an inner side of the housing half, instead of using the sun gears. This internal gear would then mesh with the planetary gears.

In the present description, references to a point in the grooves 9 and 10 refer to a center line of the groove. Necessarily, the inner edge and outer edge of the groove are slightly displaced from the center line of the groove.

The cat and mouse type rotary engine, and the cat and mouse type rotary engine with fluid compressor/blower of the present invention do not require valves for the intake and exhaust passages, as mentioned above. However, valves for the intake and exhaust passages can be added to make it easy to adjust intake and compression timing, or ignition and fuel injection timing, or to make a structure that alternately cools chambers in turn.

Gears can be replaced with roller-shaped or other types of elements, so long as they do not slip with respect to one another.

Operation of the invention will now be described.

Rotorheads 3 and 4 are located close to igniter or fuel injector 17, and a power (combustion) process is about to take place in a chamber of the annular volume contained between these two rotorheads. At the same time, rotorheads 5 and 6 are located close to intake hole 18, and an intake process is about to begin in a portion of the annular volume between these two rotorheads. Rotors 1 and 2 and shaft 20 should rotate clockwise, as viewed from the rotor 1 side of the device.

Figure 3:
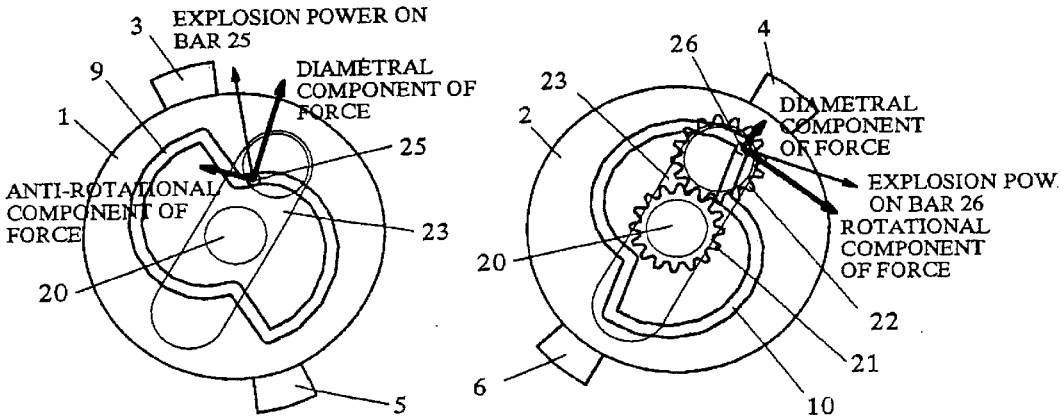
FIG. 3 is a diagrammatic representation of forces applied to various components of the invention during different portion of the overall motion.

At this time, as illustrated in FIG. 3, bar 26 is located in groove 10 on rotor 2 at a generally straight portion of the groove near its tip. When combustion occurs, the explosive power acts directly on rotorhead 4, which conveys the force to bar 26 through groove 10. Since bar 26 is located in a generally straight section of the groove which is nearly parallel to an imaginary radial line of the shaft 20, a component of force toward rotation on bar 26 (perpendicular to a radial direction) is large and a radial component of force is small. In other words, bar 26 receives a large force that tries to move bar 26 in a rotational direction. Therefore, bar 26 starts to move in a rotational direction around a meshing point of sun gear 21 and planetary gear 22 as a pivot.

On the other hand, bar 25 is, at the same time, located in groove 9 on rotor 1 at a point slightly forward from a V-point of the dual-comma groove shape, and receives counter-rotational force from rotorhead 3 through groove 9. Since the tangential line of the curve where bar 25 is located is close to the rotational direction, a component of force toward counter-rotation is small and a radial component of force is large at bar 25. In other words, the force applied to bar 25 in a counter-rotational direction is relative small compared to the forward rotational force applied to bar 26.

The resolution of forces results in shaft 20 and rod 23 rotating clockwise.

Rotor 2 also starts to rotate while pushing bar 26 with groove 10. Bar 26 moves toward the V-point of groove 10, as planetary gear 22 rotates around shaft 20. When bar 26 has moved past the V-point, rotorhead 4 reaches a point recently occupied by rotorhead 5.

In the mean time, since the path followed by bar 25 is nearly parallel to the curved line of the dual-comma shaped groove 9 at a point where bar 25 is located, groove 9 is pushed by bar 25 toward a rotational direction at a relatively slow rate. That means that rotor 1 is forced to rotate in a rotational direction at a slow rate also. When bar 25 reaches a point in a generally straight segment past the tip of groove 9, rotorhead 3 reaches a point previously occupied by rotorhead 4. When all of these movements are completed, the power process between rotorheads 3 and 4 is over, and the intake process between rotorheads 5 and 6 comes to an end.

At the same time, the exhaust process between rotorheads 4 and 5, and the compression process between rotorheads 6 and 3 have finished, too. Next, an intake process and a power process will start among these rotorheads. The cycle thus repeats indefinitely.

The positions of bars 25 and 26, at the time explosion occurs, may differ from what was explained above, depending on a rotation speed of the rotors and the timing of ignition and fuel injection.

In the above explanation, only one cycle of intake, compression, power, and exhaust occurs at any one time. If 4, 6, or a larger even number of rotorheads are installed on each rotor, and plural intake passages, exhaust passages, and igniters/fuel injectors are installed in a housing, then plural cycles of intake, compression, power, and exhaust take place at one time in a machine. When 4 rotorheads are attached to a rotor, the gear ratio of the sun gear to the planetary gear is 2:1. When 6 rotorheads are attached to a rotor, the gear ratio of the sun gear to the planetary gear is 3:1, and so on. The shape of the groove on the side of rotor, accordingly, should be a pinwheel that has four tips, six tips, and so on. Only one rod is required, although a two-rod structure also works well.

Figure 4:
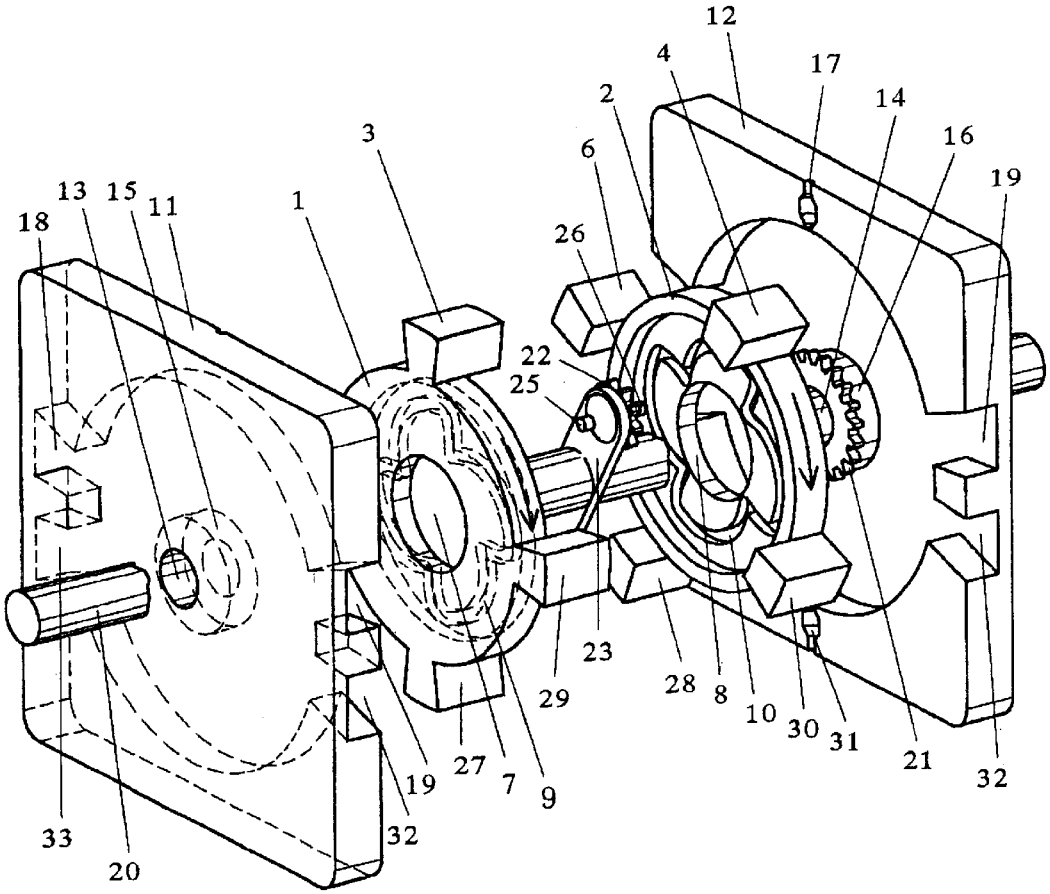
FIG. 4 is an exploded view of an embodiment of the invention utilizing four rotorhead on each rotor.

FIG. 4 illustrates an embodiment using four rotor heads per rotor. In addition to the rotorheads 3–6 of the embodiment of FIG. 1, this embodiment includes rotorheads 27–30. Also, passages 32 and 33 are provided in addition to passages 18 and 19. Grooves 9 and 10, instead being shaped as overlapping commas, instead are generally shaped as four-pointed pinwheels. Operation is the same as that discussed above, except that plural cycles are taking place at any given point in time.

In the embodiment of FIG. 4, rotorheads 3 and 4 are located close to igniter 17, rotorheads 27 and 28 are located close to igniter 31, rotorheads 5 (hidden in FIG. 4) and 6 are, at the same time, located close to intake passage 18, and rotorheads 29 and 30 are located close to intake passage 32. Two cycles of intake and explosion take place among these rotorheads at one time.

The structure of this embodiment is almost the same as the first embodiment except for the added rotorheads, tips and V-points of the rotors, intake and exhaust passages, and igniters. The operation is exactly the same as the first embodiment except for two cycles of intake, compression, power, and exhaust take place at one time.

When 3, 5, or a larger odd number of rotorheads are installed on each rotor, and one or plural intake passages, exhaust passages, and igniters/fuel injectors are installed in a housing, while a cycle or plural cycles of intake, compression, power, and exhaust is/are taking place, a cooling cycle to cool down the rotorheads and the inside of the housing can take place at the same time. This is accomplished by drawing in a liquid or gas coolant instead of fuel. If, instead, a tank or a nozzle is connected to the exhaust passages which had been used for cooling, then the device operates as a blower or compressor.

In this embodiment, the gear ratio of the sun gear to the planetary gear is 3:2, 5:2, and so on. Accordingly, the shape of the groove on the side of rotor is a pinwheel that has 3 tips, 5 tips, and so on.

When 4, 6, or a larger even number of rotorheads are installed on each rotor, and plural intake passages, exhaust passages, and igniters/fuel injectors are installed in a housing, 4 or 8 chambers that were used for intake, compression, power, and exhaust can be used for cooling or can be adapted so that the device operates as a blower or compressor, as discussed above.

Only one rod is required in any of these embodiments, but a structure with two rods also works well.

Figure 6:
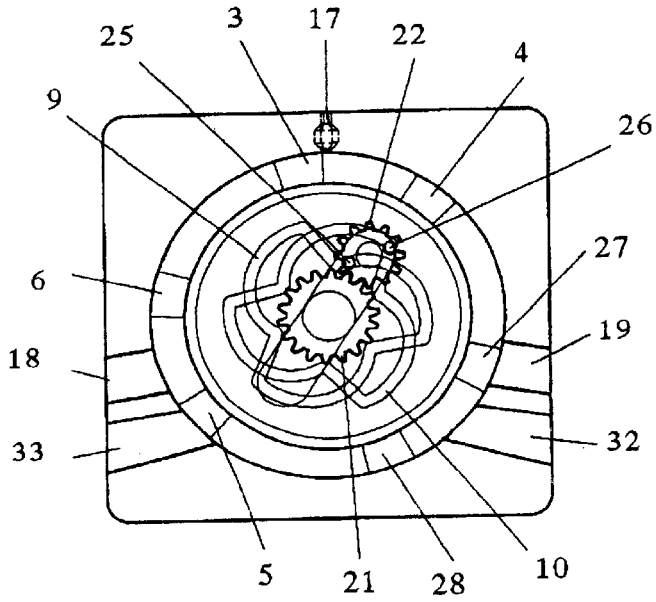
FIG. 6 is an illustration of an embodiment of the invention utilizing three cycles.

FIG. 6 is a diagrammatic view according to another embodiment of the invention, viewed from the rotor 1 side. Among various embodiments of this invention, this embodiment is a cat and mouse type rotary engine with a cooling system to cool both the rotorheads and the inside of the housing. The structure is of three rotorheads on each rotor, of shape of the groove being that of a pinwheel that has three tips, with the gear ratio of sun gear to the planetary gear being 3:2. While a cycle of intake, compression, power, and exhaust is taking place in four chambers, cooling cycles also take place in the other two chambers at the same time.

The number of rods, sun gear, planetary gear, intake passage, exhaust passage, and igniter is one each, as with the first embodiment. When an intake cycle takes place between rotorheads 5 and 6, a compression cycle takes place between rotorheads 6 and 3, an power cycle takes place between rotorheads 3 and 4, and an exhaust cycle takes place between rotorheads 4 and 27. Then cooling cycles take place between rotorheads 27 and 28, and also between rotorheads 28 and 5, using intake passage 32 and exhaust passage 33 both for cooling.

This embodiment can be modified to be a cat and mouse type rotary engine with cooling system for all chambers, by adding intake/exhaust valves to additional intake/exhaust passages installed near igniter 17, as well as adding intake/exhaust valves to intake/exhaust passages 34 and 35, and adding an additional igniter between intake/exhaust passages 34 and 35. Thus, every chamber can be cooled by outside air drawn in during every other cycle.

Figure 7:
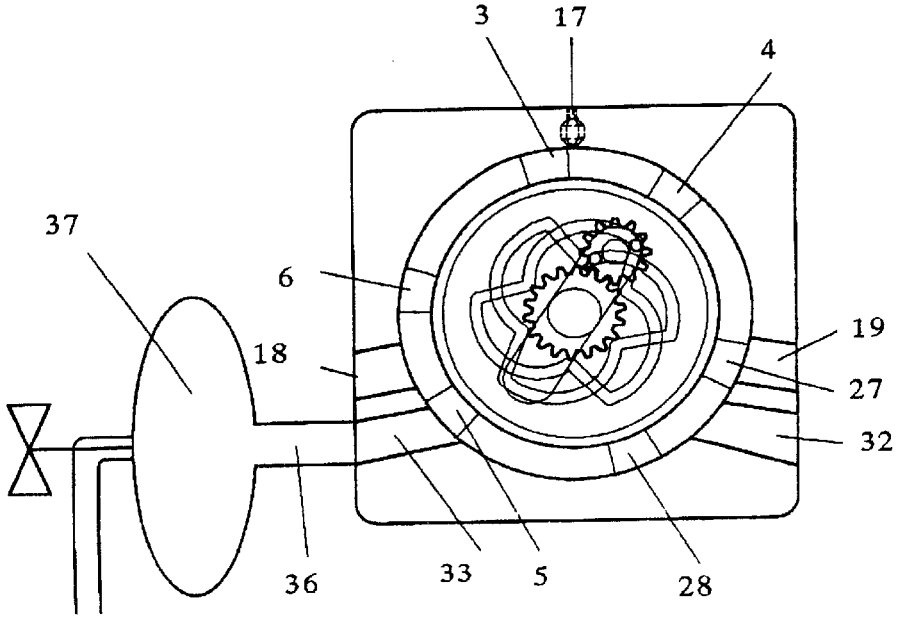
FIG. 7 is an illustration of an embodiment of the invention in which the device is used as a compressor to fill a storage tank.

FIG. 7 is a diagrammatic view according to another embodiment of the invention, viewed from the rotor 1 side. This embodiment is a cat and mouse type rotary engine with an air compressor. It includes a tank 37 connected to cooling/exhaust passage 33. With three rotorheads on each rotor, the groove being shaped as a pinwheel that has three tips, and the gear ratio of the sun gear to the planetary gear being 3:2, as in the fourth embodiment. While a cycle of intake, compression, power, and exhaust takes place, an air compression cycle also takes place at the same time.

By connecting a nozzle to the exhaust holes instead of the air tank in this embodiment, the structure will be converted to a cat and mouse type rotary engine with an air blower.

In the embodiments described thus far, the device has comprised an engine which takes in fuel and produces motion, either to simply provide rotary power or to function as a blower or compressor. The device can also be converted to a non-engine cat and mouse type rotary fluid compressor/blower (with no intake, compression, power, and exhaust cycle) by removing the igniter/fuel injector, adding intake/exhaust passages as well as a tank or nozzle, and coupling an external motor to the shaft that had been used as the output shaft in the previous embodiments.

Figure 8:
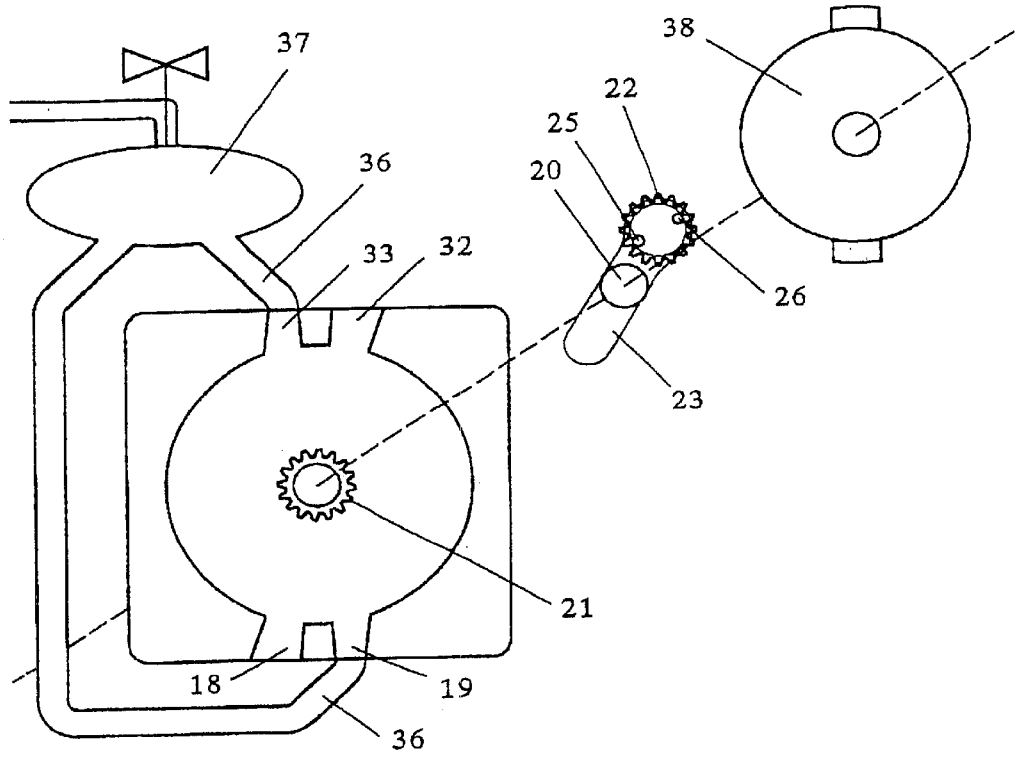
FIG. 8 is an illustration of an embodiment of the invention in which the cat and mouse device is used as a compressor driven by an external power source.

FIG. 8 is a diagrammatic view of such an embodiment of the invention, showing the housing, sun gear, planetary gear, tank, shaft, rod, bars, and outer motor in staggered layout, looking from the rotor 1 side. This represents a cat and mouse type rotary air compressor using an external motor.

The structure is almost the same as the first embodiment except for no intake, compression, power, and exhaust cycles takes place in this embodiment. An external motor 38 is connected to the input shaft, which in other embodiments operated as an output shaft. Additional intake passage 32 and exhaust passage 33 are installed near the location where an igniter 17 is located in other embodiments. Exhaust passages 19 and 33 provide paths for compressed air to go to tank 37.

Connecting a nozzle to the exhaust holes instead of the air tank will convert this structure to a cat and mouse type rotary air blower using an external motor.

As described above, the interaction between the bars 25 and 26 and the rotor grooves 9 and 10 is such that counteracting forces applied by pairs of rotorheads to their associated bars are unequal. This derives from the fact that at the time of combustion, the bars will be at different points in their respective grooves. The way forces are resolved results in the force which is applied in the forward rotational direction being greater than the force which is applied in the opposite direction.

However, since only the bars and grooves restrain mutual movements of rotors and output shaft, if the combustion power or a compression reaction inversely effects each rotor, or if inertia of the rotor exceeds the speed of the shaft, then at points where the groove most significantly bends, the bar may not move forward into a portion of the groove into which the bar is supposed to move, and instead moves backward into a portion of the groove where the bar just left, resulting in deadlock of both rotors and malfunction of the mechanism.

A further embodiment of the present invention addresses this potential problem of the cat and mouse engine using the bar and groove arrangement described in detail thus far. A feature of this invention is one or more protuberances which are installed on a side of the planetary gear. Each such protuberance collides with a corresponding protuberance installed near the V-point of the groove on the rotor at a point in the rotational cycle in which the bar is about to move in reverse direction for the reasons mentioned above. This prevents the bar from returning to a portion of the groove which it just exited.

Figure 9:
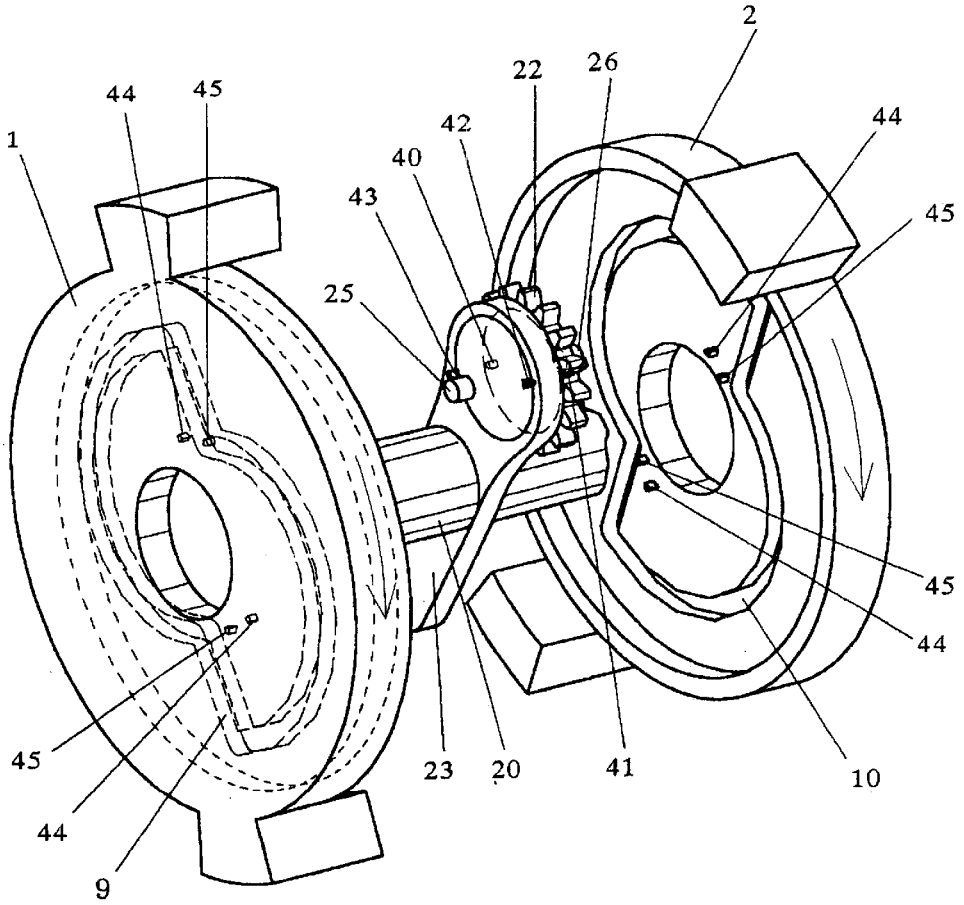
FIG. 9 is an exploded view of an embodiment of the invention which includes protuberances on the planetary gear and the rotors to prevent backward rotation of the rotors.

FIG. 9 is an exploded view of an embodiment including such protuberances. The elements illustrated in FIG. 9 are identical to the corresponding elements of FIG. 1, except for the newly included protuberances. As with the embodiment of FIG. 1, planetary gear 22 is rotatably attached to rod 23. Bars 25 and 26 extend away from opposite sides and diametrically opposite positions near the circumference of planetary gear 22, in such a manner that bars 25 and 26 ride in grooves 9 and 10 disposed on rotors 1 and 2, respectively.

In addition to bars 25 and 26, 4 protuberances are installed on both sides of planetary gear 22. Protuberance 43 is positioned near bar 25, protuberance 42 is positioned on the same side of the planetary gear 22, but diametrically opposite bar 25. Protuberance 41 is positioned near bar 26. Protuberance 40 is positioned on the same side of planetary gear 22 as protuberance 41, but diametrically opposite bar 26. Each protrusion extends generally in a direction parallel to the rotational axis of the shaft 20, and each is shorter than the bars. In addition to sufficient space existing between the rotors 1 and 2 so that the rod 23 and planetary gear 22 do not touch the sides of the rotors 1 and 2 while rod 23 rotates with planetary gear 22, there is also sufficient space between sides of the planetary gear 22 and sides of rotors 1 and 2 so that protuberances on the planetary gear and rotors do not touch the sides of the planetary gear and rotors.

In addition to protuberances 40–43 on the planetary gear 22, protuberances 44 and 45 are arranged on the groove side of each of rotors 1 and 2 on the anti-rotational side of the V-point of the groove. Protuberance 45 is closer to the V-point than is protuberance 44, which is located farther from the V-point in the anti-rotational direction. The extent to which each of protrusions 44 and 45 extend from the face of the rotor is less than a length of the bars. One protuberance 44 and one protuberance 45 is arranged in connection with each V-point of each groove. In an embodiment such as that illustrated in FIG. 9, since there are two V-points on each rotor groove, there are two protuberances 44 and two protuberances 45 on each rotor.

Figure 10:
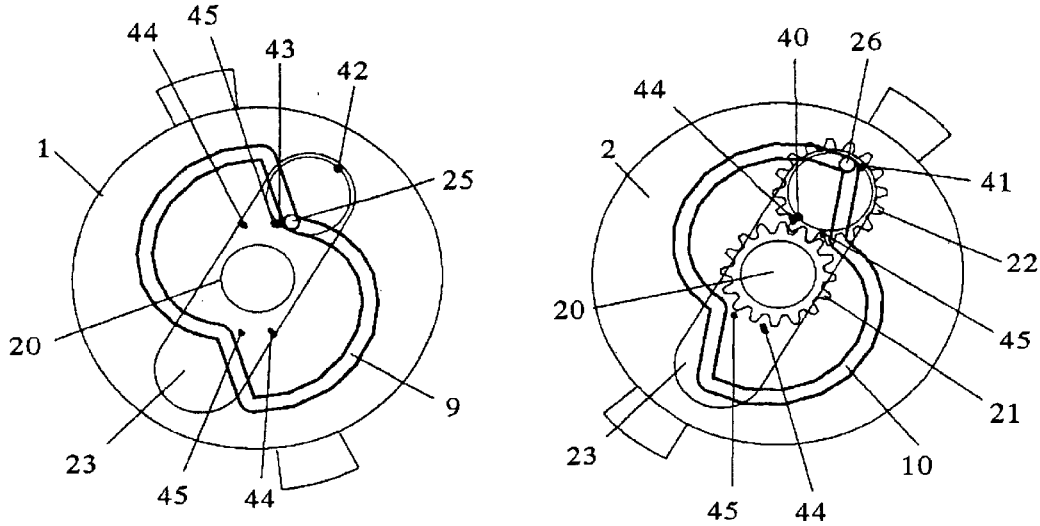
FIG. 10 is a diagrammatic representation of an embodiment of the invention utilizing the protuberances.
Figure 11:
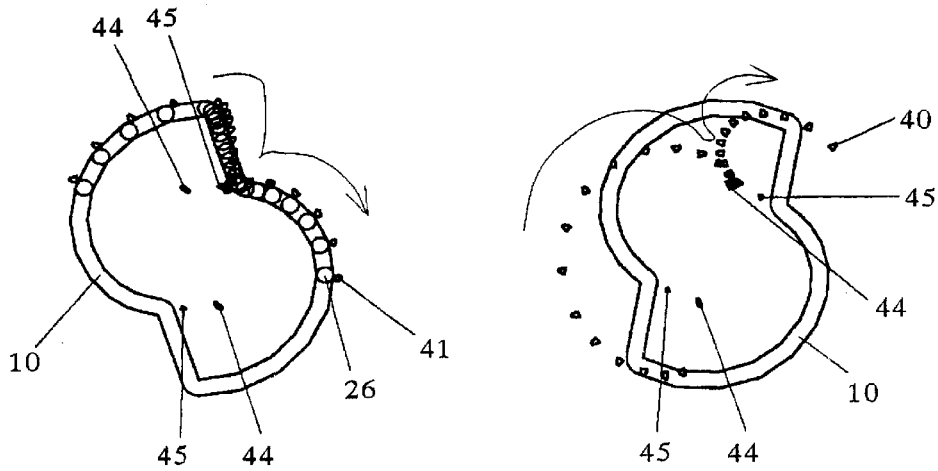
FIG. 11 is a diagrammatic representation of an embodiment of the invention utilizing the protuberances, showing the path taken by the bar and protuberances on the planetary gear.

Operation of the cat and mouse engine including such protuberances is illustrated in FIG. 10 and FIG. 11. As bar 26 nears a tip of the dual-comma shaped groove 10 of rotor 2, protuberance 40 on planetary gear 22 nears protuberance 44 on rotor 2 from a rotationally advanced direction after having traveled along an arcuate path. When bar 26 reaches the tip of groove 10, protuberance 40 on planetary gear 22 almost touches protuberance 44 on the rotor 2. At this time, if a rotational speed of rotor 2 is faster than that of bar 26, and bar 26 is about to travel backward in groove 10, protuberance 44 collides with protuberance 40. This prevents bar 26 from traveling backward.

Furthermore, protuberance 40 is positioned near shaft 20 at this point in its travel, and this position acts to allow a tip of protuberance 40 to kick protuberance 44 as planetary gear 22 rotates when protuberance 40 has a rectangularly shaped tip. That helps bar 26 move faster than the rotation of rotor 2. Thus, bar 26 continues forward to the generally straight line portion of groove 10 as it is supposed to.

When bar 26 is located at a V-point of the dual-comma shaped groove 10 and is going to move up toward a curved line of the groove, protuberance 41 on planetary gear 22 works in conjunction with protuberance 45 on rotor 2 as discussed above in connection with protuberances 40 and 44, preventing bar 26 from reversing direction.

For bar 25 on the other side of planetary gear 22 which travels in groove 9 on rotor 1, collisions between protuberances 42 and 43 and between protuberances 44 and 45 prevent bar 25 from reversing direction. Thus, smooth rotation of rotors continues as it is supposed to.

FIG. 12 is an exploded view of another embodiment utilizing protuberances. In this embodiment, two separate planetary gears are rotatably mounted at opposite ends of a rod, with only one bar extending away from each planetary gear. A double-comma shaped groove is again provided on a side of each rotor. Two protuberances are provided on each planetary gear on the same side as the corresponding bar is positioned. The shape of the grooves is modified from that of previous embodiments in that the straight lines are replaced with slightly curved lines.

The relative locations and function of the protuberances are the same as those of the first embodiment, except that the total of four planetary gear protuberances are split between two separate planetary gears.

Figure 13:
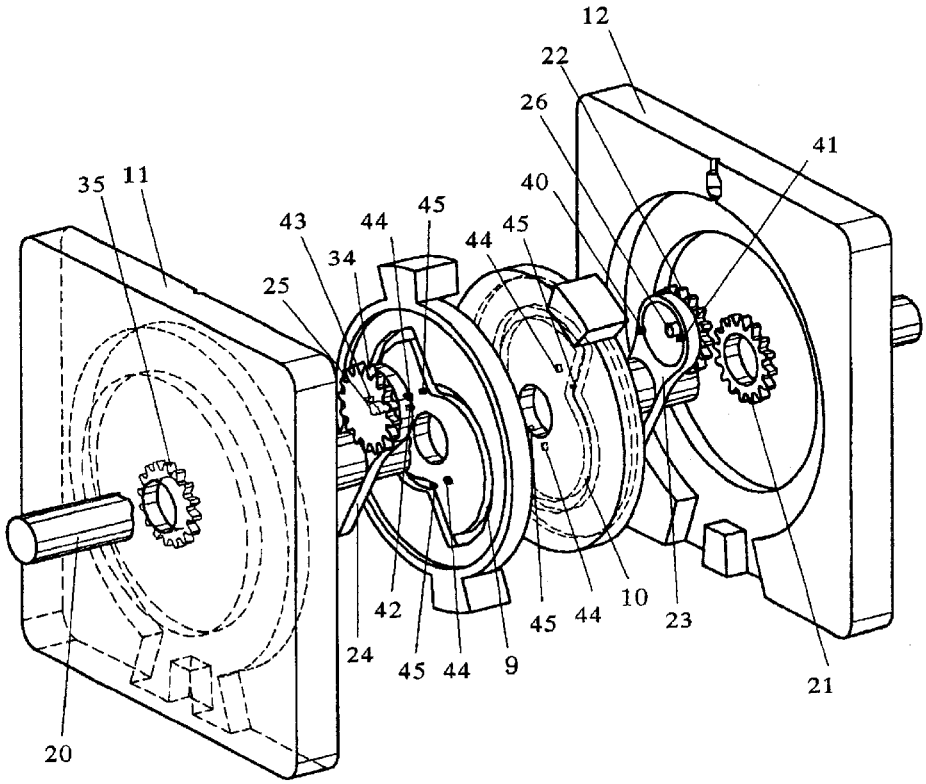
FIG. 13 is an exploded view of another embodiment utilizing the protuberances and including two separate rods.

FIG. 13 illustrates an embodiment similar to that of FIG. 4, except for the inclusion of protuberances 40–43 on the planetary gears on the separate rods 23 and 24, as well as protuberances 44 and 45 on the grooved faces of the rotors 1 and 2. The protuberances interact in the same manner as discussed above, and therefore further explanation is omitted.

Figure 14:
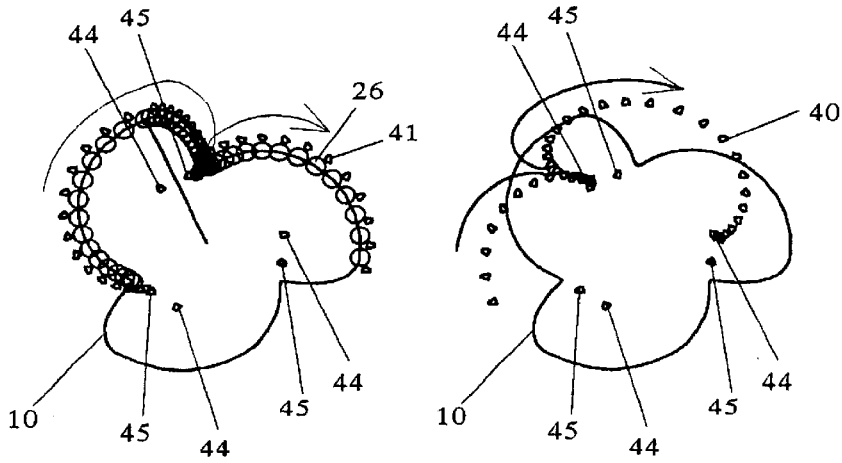
FIG. 14 is a diagrammatic representation of the invention utilizing the protuberances and having three rotorheads per rotor.

FIG. 14 is diagrammatic view showing tracks drawn by protuberances 40 and 41, and bar 26 on planetary gear 22 relative to protuberances 44 and 45 near groove 10 on rotor 2. This represents an application of this invention to a cat and mouse type rotary engine with a cooling system to cool the rotorheads and the inside of the housing. Three rotorheads are included on each rotor, and a pinwheel-shaped groove with three tips/V-points is arranged on a side of each rotor. The gear ratio of the sun gear to the planetary gear is 3:2. While a cycle of intake, compression, power, and exhaust takes place in four chambers, cooling cycles also take place in the other two chambers at the same time.

Protuberances for planetary gears are installed on both sides of planetary gear, corresponding to the bars installed on both sides of planetary gear. Since there are three V-points in each groove, six protuberances are installed on each rotor. Relative location of protuberances and their function are the same as already discussed, so further explanation is omitted here.

Figure 15:
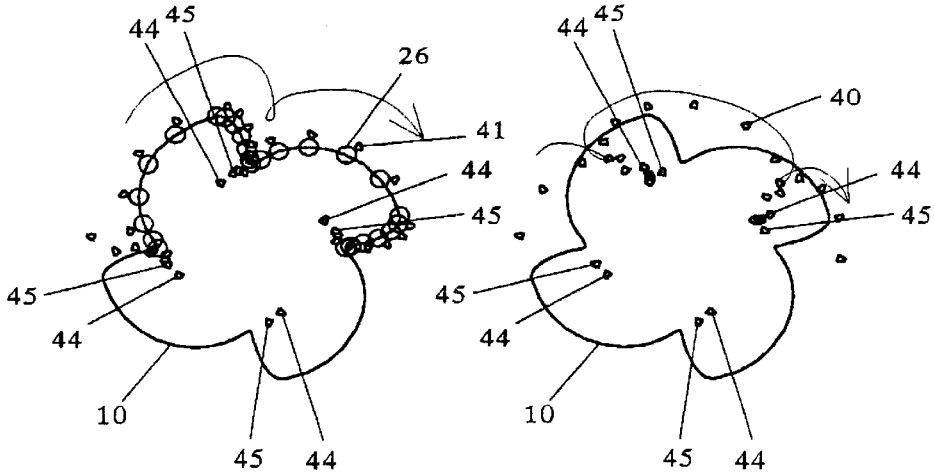
FIG. 15 is a diagrammatic representation of the invention utilizing the protuberances and having four rotorheads per rotor.

FIG. 15 is a diagrammatic view of a protuberance embodiment, showing tracks drawn by protuberances 40 and 41, and bar 26 on planetary gear relative to protuberances 44 and 45 near groove 10 on rotor 2. This embodiment is a cat and mouse type rotary engine with two sets of power cycle at one time. Four rotorheads are provided on each rotor, so the shape of the groove as a pinwheel that has four tips/V-points on a side of each rotor. The gear ratio of the sun gear to the planetary gear is 2:1. Two sets of intake passages, exhaust passages, and igniters are installed in the housing, and two cycles of intake, compression, power, and exhaust take place at a time. Protuberances of the planetary gears are installed on both sides of planetary gear, corresponding to the planetary gear bars.

Since there are four V-points in each groove, eight protuberances are installed on a side of each rotor. Relative location of protuberances and their function are the same as discussed previously.

The present invention is not limited to the particular embodiments that have been described, which are presented only as typical examples. The shapes of grooves, rods, and bars, as well as the way these elements are interconnected allow for many variations. Other friction reduction methods and materials can also be utilized in addition to or instead of those particularly described.

I claim:

1. A cat and mouse type device comprising:

a housing;

a shaft rotatably mounted within the housing;

first and second rotors rotatably mounted within the housing, each of the rotors having at least two rotorheads arranged around a perimeter of the rotor, the rotors being mounted within the housing to define an annular volume, with the rotorheads dividing the annular volume into a plurality of chambers, each of the rotors having a groove disposed on a face of the rotor;

at least one rod secured to the shaft within the housing; at least one primary gear rotatably mounted to each of the at least one rod;

at least one secondary gear mounted within the housing and surrounding the shaft;

at least one bar extending away from the at least one primary gear;

at least one inlet passage and at least one outlet passage in the housing, each said inlet and outlet passage opening into the annular volume;

wherein each of the bars is arranged to ride in one of the rotor grooves and each of the at least one primary gear is meshed with the at least one secondary gear.

2. The cat and mouse type device of claim 1, wherein the cat and mouse device includes only one said rod, said rod being disposed between the two rotors.

3. The cat and mouse type device of claim 2, wherein only one said primary gear is rotatably mounted to the one rod, a first of the bars extending in a first direction toward an inner said face of one of the rotors, a second of the bars extending in a second direction opposite the first direction toward an inner said face of another of the rotors.

4. The cat and mouse type device of claim 2, wherein there are two said primary gears rotatably mounted at opposite ends of the rod so that one of the primary gears faces one of the rotors and another of the primary gears faces another of the rotors, and wherein a first of the bars extends away from one primary gear toward an inner said face of said first rotor, a second of the bars extending away from another primary gear toward an inner said face of said second rotor.

5. The cat and mouse type device of claim 1, wherein the cat and mouse device includes two said rods, each of the rods being disposed between the housing and an outer face of a respective one of the rotors, and wherein a first of the bars extends way from one said primary gear toward an outer said face of said first rotor, a second of the bars extending away from another said primary gear toward an outer said face of the second rotor.

6. The cat and mouse type device of claim 1, wherein the cat and mouse device is a rotary engine, further comprising an ignition element arranged in the housing, the ignition element opening to the annular volume, wherein the at least one inlet passage comprises a fuel inlet passage and the at least one outlet passage comprises an ignition exhaust outlet passage.

7. The cat and mouse type device of claim 1, wherein a gear ratio between the secondary gear and the primary gear is n:2, where n is a number of rotorheads on each said rotor.

8. The cat and mouse type device of claim 7, wherein each said rotor groove is divided into n cycles, an innermost point in each said cycle being defined by a position of a corresponding one of said bars when said bar is nearest a rotational axis of the shaft as the primary gear travels around the secondary gear, an outermost point in each said cycle being defined by a position of said corresponding bar when it is farthest from the rotational axis of the shaft as the primary gear travels around the secondary gear.

9. The cat and mouse type device of claim 8, wherein each said cycle includes a first arcuate section that intersects a radial line extending from the center of the rotor swept over a large angle, said first arcuate section being traveled by the corresponding bar from the innermost point to the outermost point.

10. The cat and mouse type device of claim 9, wherein each said cycle includes a second section that intersects a radial line extending from the center of the rotor swept over a small angle, said second section being traveled by the corresponding bar from the outermost point to the innermost point.

11. The cat and mouse type device of claim 1, wherein the cat and mouse device is a pump and the shaft is adapted to be turned by an external motor so that rotation of the shaft causes the rotors to move within the housing to draw a fluid in the at least one inlet passage and expel the fluid from the at least one outlet passage.

12. The cat and mouse type device of claim 1, wherein the cat and mouse device is a combination rotary engine and pump comprising at least two said inlet passages of which at least one is a fuel inlet passage and at least one is a fluid inlet passage, the cat and mouse device further comprising at least two said outlet passages of which at least one is an ignition exhaust outlet passage and at least one is a fluid outlet passage.

13. The cat and mouse type device of claim 1, wherein the cat and mouse device is a rotary engine with an integral cooling function comprising at least two said inlet passages of which at least one is a fuel inlet passage and at least one is a coolant inlet passage, the cat and mouse device further comprising at least two said outlet passages of which at least one is an ignition exhaust outlet passage and at least one is a coolant outlet passage.

14. The cat and mouse type device of claim 1, further comprising:

primary gear protuberances extending away from each said primary gear; and rotor protuberances extending away from each said rotor;

wherein the primary gear protuberances are arranged to interact with the rotor protuberances to prevent the rotors from reversing a direction of rotation during operation.

15. The cat and mouse type device of claim 14, wherein at most two said primary gear protuberances are provided in relation to each said bar.

16. The cat and mouse type device of claim 15, wherein each said rotor groove is divided into a plurality of cycles, an innermost point in each said cycle being defined by a position of a corresponding one of said bars when said bar is nearest a rotational axis of the shaft as the primary gear travels around the secondary gear, an outermost point in each said cycle being defined by a position of said corresponding bar when it is farthest from the rotational axis of the shaft as the primary gear travels around the secondary gear; and wherein at most two of the rotor protuberances are arranged near the innermost point of the groove in each of the cycles.

17. The cat and mouse type device of claim 16, wherein two said primary gear protuberances are provided in relation to each said bar, a first of the two primary gear protuberances being located proximate said bar and a second of the two said primary gear protuberances being provided generally diametrically opposite the bar on the primary gear.

18. The cat and mouse type device of claim 17, wherein two of the rotor protuberances are arranged near the innermost point of the groove in each of the cycles.

19. The cat and mouse type device of claim 18, wherein each of said first rotor protuberances is positioned to make contact with said first of the primary gear protuberance, each of said second rotor protuberances being positioned to make contact with said second of the primary gear protuberance.

20. The cat and mouse type device of claim 16, wherein only one said primary gear protuberance is provided in relation to each said bar, said primary gear protuberance being located proximate said bar on the primary gear, and only one rotor protuberance is provided near the innermost point of the groove in each of the cycles to make contact with said primary gear protuberance.

21. The cat and mouse type device of claim 16, wherein only one said primary gear protuberance is provided in relation to each said bar, said primary gear protuberance being located generally diametrically opposite the bar on the primary gear, and only one rotor protuberance is provided near the innermost point of the groove in each of the cycles to make contact with said primary gear protuberance.

* * * * *